US005361537A

United States Patent [19]

Behrens

[11] Patent Number: 5,361,537

[45] Date of Patent: Nov. 8, 1994

[54] NOISE PROTECTION WALL

[76] Inventor: Wolfgang Behrens, Trespenmoor 25, W-2833 Gross Ippener, Germany

[21] Appl. No.: 902,673

[22] Filed: Jun. 23, 1992

[51] Int. Cl.[5] ..... E01F 8/00; A01G 9/02; A01G 27/00

[52] U.S. Cl. ..... 47/82; 47/83

[58] Field of Search ..... 47/82, 83

[56] References Cited

FOREIGN PATENT DOCUMENTS 0393735 10/1990 European Pat. Off. ..... 47/82
3812394 11/1989 Germany .
0815195 3/1981 U.S.S.R. ..... 47/82

*Primary Examiner*—Carl D. Friedman
*Assistant Examiner*—Robert J. Canfield
*Attorney, Agent, or Firm*—Collard & Roe

[57] ABSTRACT

A noise protection wall having a height with a framework for holding and receiving wall elements, with the wall elements including cassettes containing a nutrient medium, the cassettes being arranged one on top of the other for forming the height of the wall, each cassette having a total vertical area; each of the cassettes being precultivated and covered with lower and higher plants and includes a supporting and protecting rack for a complete structural element having the nutrient medium and water mats arranged therein; the watering mats having water-storing properties and water-releasing properties; a droplet watering system on top of the noise protection wall; and a cement fiber slab extending across the total vertical area of each cassette and arranged in the center of each cassette.

6 Claims, 2 Drawing Sheets

NOISE PROTECTION WALL

BACKGROUND OF THE INVENTION

1. Field of the Invention

The present invention relates to a noise protection wall. More particularly, it relates to noise protection walls which are set up along traffic routes in order to protect wayside residential areas against the noise coming from the traffic route.

2. The Prior Art

Most noise protection walls are made from galvanized steel posts having exchangeable wall elements mounted between such posts. Certain frequencies are damped or diminished to a lesser or greater degree, depending on the construction material and the wall system. Elements which predominantly reflect the sound have a low wall cross-section and are manufactured from, for example, concrete, metal or plastic profiles. On the other hand, elements which absorb the sound for the most part have a wider structure and are composed of a porous material, for example, an open-pore expanded concrete, facing concrete, or rock wool. By means of such elements, the sound penetrates the open-pore materials and is converted into heat.

It is difficult to provide said elements with an aesthetic appearance. In most cases, such elements have a conspicuous structure and they are painted in bright colors. Such a construction with this appearance interferes with the natural scenery, and the popular discontent with such noise screens is growing, because they do not meet their visual needs.

Any after covering of the screens with plants that could hide such noise screens is often not possible due to lack of space, or due to the excessively high cost.

One possible solution is shown by the noise protection wall known from DE-OS 38 12 394, which is comprised of a framework for holding and receiving wall elements, whereby the latter consist of cassettes covered by plants, said cassettes being stacked one on top of the other for forming the height of the wall. Such a noise protection wall does not interfere with the natural scenery, but offers a successful appearance, aesthetically speaking. It offers a biotop for many microorganisms and ensures the elimination of harmful substances and good heat absorption.

With respect to sound damping or diminution values, a noise protection wall erected according to DE-OS 38 12 394 adequately meets the "Technical Specifications and Guidelines for the Design of Noise Protection Walls on Roadways" ("ZTV-Lsw 88"), which specify that the A-valued sound diminished value measured has to be reduced by at least 25 dB.

In recent times, the traffic volume on roadways and in the air has continued to grow; numerous new industrial zones with additional sources of noise have been developed, and many residential areas which only yesterday were located in a green landscape are now situated in the center of an industrial zone or near a heavily traveled road. Noise leads to an impairment of sound communication, of sleep and relaxation, and diseases of the vegetative nervous system. It is, therefore, understandable why noise is, according to a poll, perceived as being one of the severest impairments of the environment. A noise screen covered with green plants as the one known from DE-OS 38 12 394, which only offers adequate sound elimination or absorption, is no longer deemed acceptable.

With noise protection walls erected according to DE-OS 38 12 394, it is also particularly disadvantageous in that vertical tubes had to be installed later to distribute the load in order to increase the stability of the noise screen to the value required according to "ZTV-Lsw 88."

SUMMARY OF THE INVENTION

It is therefore an object of the present invention to provide a noise protection wall with a framework for holding and receiving wall elements, whereby the wall elements are formed by cassettes containing a nutrient medium, said cassettes being arranged one on top of the other for forming the height of the wall, whereby the cassettes are precultivated and covered with lower and/or higher plants and consist of a supporting and protecting rack as a complete structural element having the nutrient medium as well as watering mats arranged therein, said water mats having both water-storing and water-releasing properties, and whereby provision is made for a droplet watering system on top of the noise protection wall, wherein a cement fiber slab extending across the total vertical area of the cassette is arranged in the center of each cassette.

It is a further object of the present invention to provide a noise protection wall having a height with a framework for holding and receiving wall elements, comprising said wall elements comprising cassettes containing a nutrient medium, said cassettes being arranged one on top of the other for forming the height of the wall, each cassette having a total vertical area; each of said cassettes being precultivated and covered with lower and higher plants and comprises a supporting and protecting rack for a complete structural element having the nutrient medium and water mats arranged therein; said watering mats having water-storing properties and water-releasing properties; a droplet watering system on top of the noise protection wall; and a cement fiber slab extending across the total vertical area of each cassette and arranged in the center of each cassette.

The present invention solves the prior art problems and achieves the object of enhancing a noise protection wall of the type defined above by further increasing its sound damping or absorption capability and stability at about the same expenditure in terms of installation and costs without reducing the area covered by green plants and reducing the harmful substances. The noise protection wall of the invention has the following advantages.

Due to the cement fiber slab which, according to the invention, is arranged in the center of each cassette of the noise protection wall and extends across the entire vertical area of the cassette, it was surprisingly found in official measurements that the sound level through the air is reduced from about 31 to 36 dB. This means that the technical specification requiring 25 dB has been more than satisfied. Such a reduction of the noise level by about 6 to 10 dB versus a noise screen of the prior art type described above has the effect that the noise is being perceived as being only half as loud. In addition, the low and medium frequencies are damped or reduced and diminished, which frequencies have been perceived as being highly annoying. The cement fiber slab arranged in the center does not in any way interfere with the visual appearance and does not reduce the green-covered area. Furthermore, the installation of a cement fiber slab is neither costly nor intensive in terms of cost.

At the same time, the inherent stability of the cassettes is significantly enhanced by the cement fiber slab, so that the installation of additional framework or supporting elements can be dispensed with.

In a preferred embodiment of the invention, the cement fiber slab has a thickness of at least 8 millimeters.

The composite structure so obtained shifts the natural resonance of the cement fiber slab to a low, noncritical frequency range, so that the interfering sound frequencies cannot cause any excitation of the natural resonance.

In a further embodiment, provision is made according to the invention that the watering mat is located in each case in the horizontal marginal zones of a cassette on both sides of the cement fiber slab.

In another embodiment, the watering mat can be located in each case as a one-piece element on the horizontal edge of the cassette, or a one-piece watering mat can be arranged in each case between two cassettes. In this way, the nutrient medium and the plants on both sides of the cement fiber slab are always supplied with water.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 2:
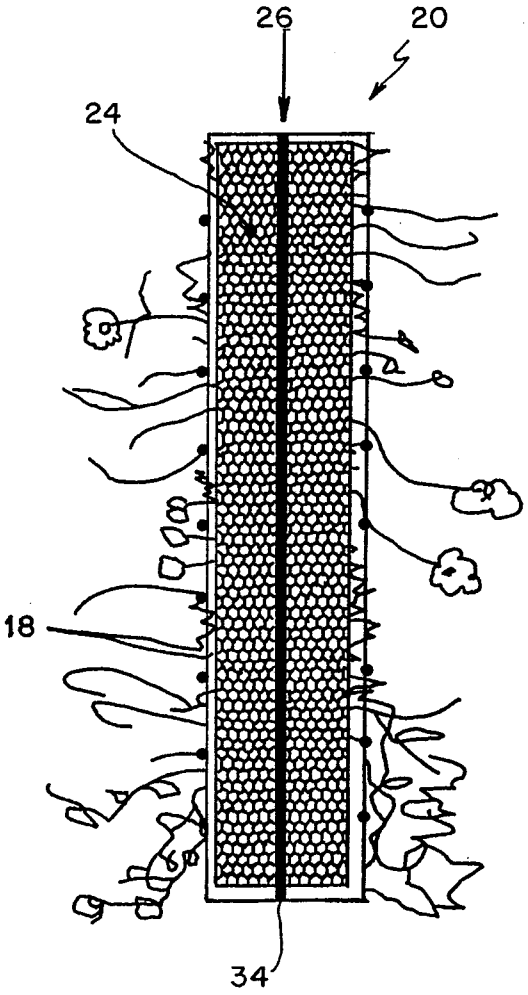
FIG. 2 shows a cross-section through a cassette in a second embodiment.
Figure 1:
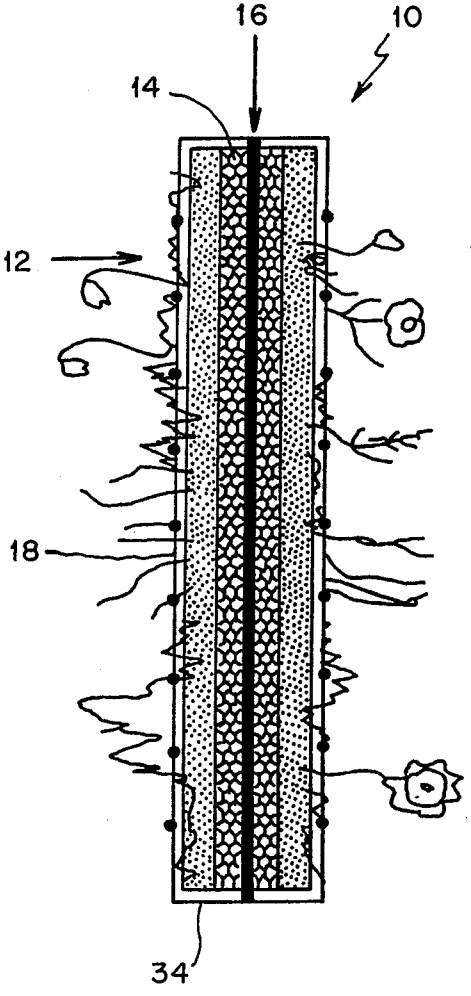
FIG. 1 shows a cross-section through a cassette of a noise protection wall, in a first embodiment.

Turning now in detail to the drawings, FIGS. 1 and 2 each show a cassette 10 and 20 of a noise protection wall according to the invention.

The cassette 10 consists of a hot-galvanized and additionally plastic-coated, latticework-like basic framework made of thin structural steel. This framework is now shown in the drawing for the sake of better clarity. A vegetation mat 12 of 19 mm thickness serving as the nutrient medium is disposed behind the longitudinal walls of the cassette on both sides of the wall. These walls are arranged vertically in the noise protection wall. A mineral fiber insulation board 14 (gross $wt._{dry}=120\ kg/m^3$) of 20 mm thickness is disposed parallel therewith. In the center of cassette 10, a cement fiber slab 16 having a thickness of 8 mm is installed between the fiber insulation boards 14. Higher and lower plants are precultivated along the two outer walls of the cassette.

The cassette 20 shown in FIG. 2 is different from the one shown in FIG. 1, in that on both sides of a cement fiber slab 26 of 8 mm thickness there is as the nutrient medium not a vegetation mat, but only a mineral fiber insulation board 24, the latter being directly covered with green plants.

The inherent stability of the cassette 10, 20 is significantly enhanced by the cement fiber slab 26, so that framework elements as normally used in practical applications for stiffening the cassette can be dispensed with.

Figure 3:
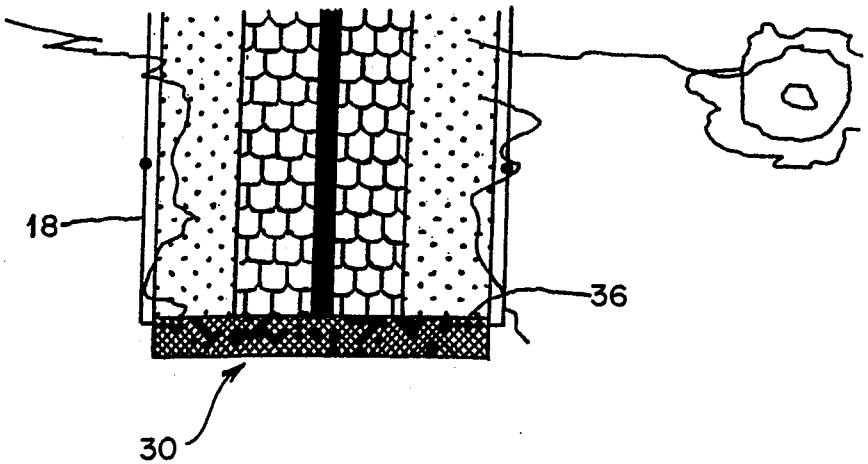
FIG. 3 shows an enlarged cutout from FIG. 1.

FIG. 3 shows an enlarged cutout of FIG. 1 showing the lower end zone of the cassette 10, with a one-piece watering mat 30 being located on the lower horizontal edge of the cassette 10. This mat 30 causes the water, which is supplied via a droplet watering system 34 or a drip irrigation system, at the top end of the noise protection wall, to be retained in each case in the cassettes and released evenly metered to the plants on both sides of the cement fiber slab.

Figure 4:
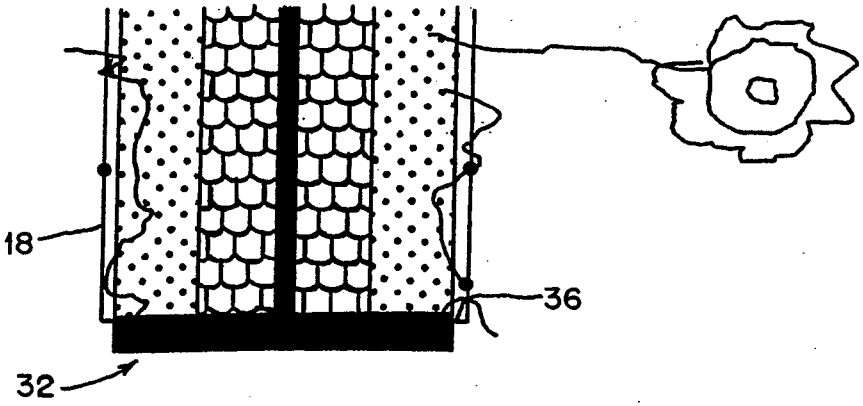
FIG. 4 shows an alternative exemplified embodiment based on FIG. 3.

Of course, it is possible also, as is shown in FIG. 4, to provide the watering mat in two parts and to arrange this mat on both sides of the fiber insulation board 16 in the marginal zone of the cassette.

The sound damping absorption value of 25 dB required in specification "ZTV Lsw 88" issued by the Federal Minister of Transport is satisfied by the two cassettes 10 and 20 with values in the range of 31 and 36 dB, which is easily exceeding the required value by a substantial amount.

Figure 5:
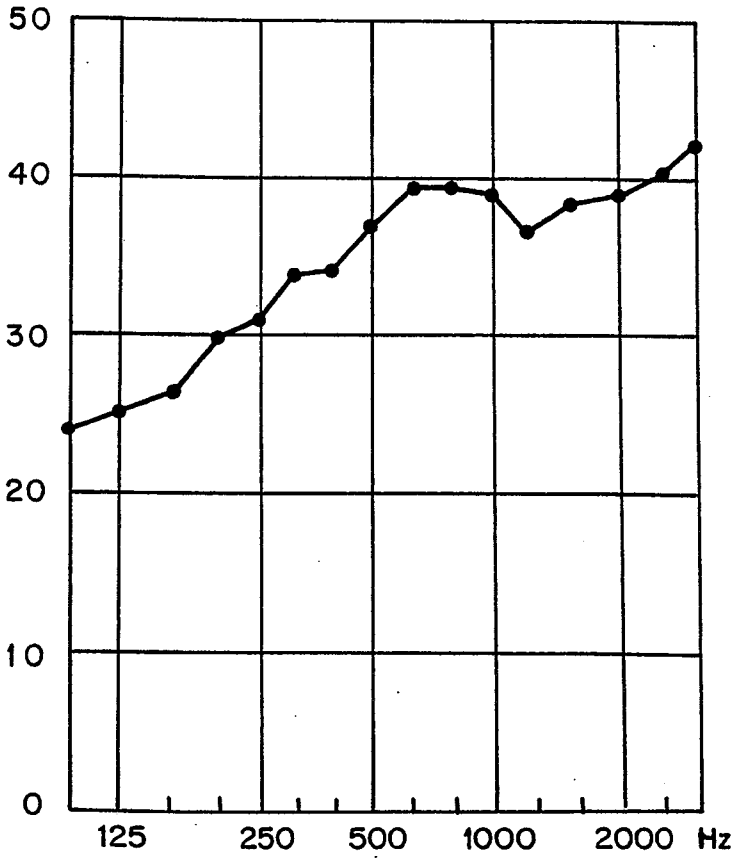
FIG. 5 is a graphic representation of the values measured in the sound damping test on the noise protection wall.

FIG. 5 shows a graphic representation of the values measured in the sound damping absorption test of the cassette, which test was carried out within the guidelines of the test procedure according to "ZTV-Lsw 88." This test procedure is referred to by the designation DIN 52 210-03-M-L-P-2. The abscissa shows the frequency f, whereas the sound diminution measure R is plotted on the ordinate. With the noise protection wall according to the invention, the rated sound damping value measured between 34 and 39 dB. The particularly good diminution properties are found in the medium and low frequency ranges.

While several embodiments of the present invention have been shown and described, it is to be understood that many changes and modifications may be made thereunto without departing from the spirit and scope of the invention defined in the appended claims.

What is claimed is:

1. Wall elements for use with a noise protection wall having a height with a framework for holding and receiving said wall elements, said noise protection wall having a droplet watering system on the top thereof, said wall elements comprising cassettes containing a nutrient medium, said cassettes being arranged one on top of the other for forming the height of the wall, each cassette having a total vertical area;

each of said cassettes being precultivated and covered with lower and higher plants and comprising a supporting and protecting rack for a complete structural element having the nutrient medium and watering mats arranged therein;

said watering mats having water-storing properties and water-releasing properties; and a cement fiber slab extending across the total vertical area of each cassette and arranged in the center of each cassette.

2. Wall elements as defined in claim 1, wherein the cement fiber slab has a thickness of at least 8 mm.

3. Wall elements as defined in claim 1, wherein said supporting and protecting rack has horizontal areas; and wherein the cement fiber slab abuts horizontal areas of the supporting and protecting rack.

4. Wall elements as defined in claim 1, wherein each cassette has horizontal marginal zones; and wherein said watering mat is arranged in the horizontal marginal zones of said cassette on both sides of the cement fiber slab.

5. Wall elements as defined in claim 1, wherein each cassette has a horizontal edge; and wherein a one-piece watering mat is arranged on the horizontal edge of the cassette.

6. Wall elements as defined in claim 1, wherein there are two cassettes; and wherein a one-piece watering mat is between said two cassettes.

* * * * *